US011565276B2

(12) United States Patent
Krayer

(10) Patent No.: US 11,565,276 B2
(45) Date of Patent: Jan. 31, 2023

(54) PAINT SPRAYING UNIT

(71) Applicant: J. Wagner GmbH, Markdorf (DE)

(72) Inventor: Elmar Krayer, Langenargen (DE)

(73) Assignee: J. Wagner GmbH, Markdorf (DE)

( * ) Notice: Subject to any disclaimer, the term of this patent is extended or adjusted under 35 U.S.C. 154(b) by 0 days.

(21) Appl. No.: 15/956,883

(22) Filed: Apr. 19, 2018

(65) Prior Publication Data

US 2018/0236465 A1 Aug. 23, 2018

Related U.S. Application Data

(63) Continuation of application No. PCT/EP2016/077469, filed on Nov. 11, 2016.

(30) Foreign Application Priority Data

Nov. 12, 2015 (DE) ..... 20 2015 106 132.3

(51) Int. Cl.
*B05B 1/30* (2006.01)
*B05B 1/04* (2006.01)
(Continued)

(52) U.S. Cl.
CPC ..... *B05B 1/3046* (2013.01); *B05B 1/044* (2013.01); *B05B 7/066* (2013.01); *B05B 7/0823* (2013.01); *B05B 7/2424* (2013.01)

(58) Field of Classification Search
CPC ..... B05B 1/3046; B05B 7/0823; B05B 7/066; B05B 1/044; B05B 7/2424
(Continued)

(56) References Cited

U.S. PATENT DOCUMENTS 3,746,253 A * 7/1973 Walberg ..... B05B 5/03 239/705
3,870,233 A * 3/1975 Wilhelm ..... B05B 5/16 239/692
(Continued)

FOREIGN PATENT DOCUMENTS

DE 10 2009 053 449 A1 2/2011
DE 10 2009 048 022 A1 4/2011
(Continued)

OTHER PUBLICATIONS

International Search Report and Written Opinion (Application No. PCT/EP2016/077469) dated Feb. 6, 2017.

*Primary Examiner* — Qingzhang Zhou
*Assistant Examiner* — Joel Zhou
(74) *Attorney, Agent, or Firm* — Burr & Brown, PLLC

(57) ABSTRACT

A paint spraying unit for generating a shaped paint jet, including a paint nozzle positioned in a gap, wherein the paint nozzle includes a needle with a needle head that deviates from a rotationally symmetrical cross sectional design and a paint outlet opening that deviates from a rotationally symmetrical cross sectional design. The needle head is displaceable in relation to the paint outlet opening along a longitudinal axis of the needle for controlling a needle valve formed by the paint outlet opening and the needle head. The needle head, with the paint nozzle in a closed position with reference to the longitudinal axis, closes the paint outlet opening in a positive locking manner. In this connection, the needle head and/or the paint outlet opening is/are formed by a material with elastic properties at least in a surface region with which the two components come in contact.

14 Claims, 7 Drawing Sheets

(51) Int. Cl.
*B05B 7/06* (2006.01)
*B05B 7/08* (2006.01)
*B05B 7/24* (2006.01)

(58) Field of Classification Search
USPC ..... 239/690–708
See application file for complete search history.

(56) References Cited

U.S. PATENT DOCUMENTS

| | | | | |
|---|---|---|---|---|
| 2008/0121738 | A1* | 5/2008 | Togashi | B05B 1/3463 239/406 |
| 2008/0141738 | A1* | 6/2008 | Chang | E05B 65/025 70/78 |
| 2012/0160935 | A1 | 6/2012 | Krayer et al. | |
| 2012/0261500 | A1 | 10/2012 | Krayer et al. | |
| 2014/0077002 | A1* | 3/2014 | Krayer | B05B 1/3046 239/458 |
| 2014/0246516 | A1* | 9/2014 | Huang | B05B 7/0815 239/375 |
| 2015/0273499 | A1 | 10/2015 | Preston et al. | |
| 2016/0325294 | A1 | 11/2016 | MacIndoe | |

FOREIGN PATENT DOCUMENTS

| | | | |
|---|---|---|---|
| DE | 10 2016 207 803 | A1 | 11/2016 |
| EP | 0 596 939 | B1 | 12/1998 |
| GB | 2508446 | A | 6/2014 |

* cited by examiner

PAINT SPRAYING UNIT

CROSS REFERENCE TO RELATED APPLICATIONS

This application is a continuation of International Application No. PCT/EP2016/077469 filed Nov. 11, 2016, which designated the United States, and claims the benefit under 35 USC § 119(a)-(d) of German Application No. 20 2015 106 132.3 filed Nov. 12, 2015, the entireties of which are incorporated herein by reference.

FIELD OF THE INVENTION

The present invention relates to a paint spraying unit for generating a shaped paint jet.

BACKGROUND OF THE INVENTION

According to the present invention, the paint spraying unit can also be used for other air-driven application processes which utilize the function according to the present invention of the rotatable generation of the shaped paint jet of the paint spraying unit.

In the field of spraying application processes, for example, when paint spraying or lacquer spraying, there are a plurality of basic technical principles. Along with so-called airless methods, which atomize paint at high pressure and apply it onto a surface, there are a variety of methods driven by compressed air. In this case, a paint jet emerging out of a nozzle is nebulized by means of air masses flowing past (main atomizing air) and is consequently transported as paint spray mist in the direction of a working plane. The working plane, which is arranged at a suitable working distance for a coating process, is struck in this way by the paint jet and the paint is applied thereon as a result. In this connection the prior art discloses, among other things, devices which are operated by compressor compressed air and so-called HVLP devices (high volume low pressure) which differ from conventional high pressure devices in a few operating parameters, for example, the nozzle air pressure.

A generic device from the prior art is suitable for providing a flat paint jet which presents advantages when applying a paint onto a surface. Compared to a radially symmetrical round paint jet, a flat jet presents increased homogeneity when the paint is applied, similar to brushing or to an application with a roller, as a result of which the resultant paint coating is clearly improved.

The prior art, for example, EP 0 596 939 B1, discloses paint spraying devices, where a radially symmetrical, round paint jet, which emerges out of a paint nozzle, is deformed by air deflecting means, which are arranged to the side of the paint nozzle and are realized in the form of so-called air horns, such that a generated flat paint jet strikes in the region of a working plane.

Furthermore, DE 10 2009 053 449 A1 discloses a spray head for generating a flat paint jet on a paint spraying device, with which wall paint or viscous lacquer is also able to be processed well. Depending on the realization of the spray head, the generatable flat jet comprises a vertical or horizontal alignment such that it is either suitable to apply the paint optimally up to vertical or horizontal wall edges. A flat paint jet in the horizontal or vertical direction serves, above all, to make it possible for the user to coat the surfaces vertically and horizontally in the two main working directions (=movement of the gun). This is important, in particular, in order to be able to carry out so-called cross coating, where a surface is coated once in the vertical and once in the horizontal working direction one after another in order to avoid structural shadowing.

SUMMARY OF THE INVENTION

It is the object of the present invention to develop further a paint spraying unit for generating a shaped paint jet with regard to optimum sealing of the paint nozzle, the paint spraying unit being suitable to deliver the shaped paint jet—with the alignment of the paint spraying unit unchanged in space—in a varying orientation.

In the case of the paint spraying device according to the present invention for generating a shaped paint jet, the needle head and/or the paint outlet opening is or are formed by a material, in particular, plastics material, with elastic properties at least in a surface region with which the needle head and the paint outlet opening come into contact when the paint nozzle is closed. As a result, it is possible to bring about a reliably sealing closed state of the needle valve even when the needle head and/or the paint outlet openings comprise a surface structure which is changed by paint adhesions in surface regions, by way of which, with the needle nozzle in the closed state, they abut against one another. The core of the present invention is, consequently, to realize at least one component of the needle nozzle in such a manner that, with the needle nozzle in the closed position, it is able to deform temporarily to produce a sealing effect and re-assumes its provided geometry in every open position of the needle nozzle. As a result, a particularly reliable sealing effect of the needle valve is achieved without having to accept any disadvantages in spraying mode as a result. Furthermore, the configuration according to the present invention involves the advantage that a reliable sealing effect of the needle nozzle, in the closed state thereof, is achieved even when the paint outlet opening and the needle or the needle head, with reference to a longitudinal axis of the needle, are slightly misaligned with respect to one another as a result of torsion. Correspondingly, it is provided according to the present invention

- that the needle head is formed by a material with elastic properties at least in a surface region with which the two components come into contact, or
- that the paint outlet opening is formed by a material with elastic properties at least in a surface region with which the two components come into contact, or
- that the needle head and the paint outlet opening are formed by a material with elastic properties at least in a surface region with which the two components come into contact.

It is also provided to realize the paint outlet opening so as to be rotatable about the longitudinal axis together with the needle head in order to rotate the shaped paint jet in its orientation with reference to the longitudinal axis. As a result, it is possible in the simplest manner to switch between a vertical and a horizontal working direction and also to set up a diagonal working direction.

Furthermore, the needle and, in particular, the needle head is softer than a nozzle body which forms the paint outlet opening. The achievement here is that, with the needle valve in the closed position, the needle head, where necessary under elastic deformation, molds integrally onto the nozzle body and closes the paint outlet opening in a reliable manner.

It is also provided to realize the needle head softer than a needle shank of the needle. This avoids the needle being elongated or compressed to an unwanted extent when the trigger is pulled and released such that an opening of the needle valve with the needle stuck is effected too abruptly or that too low a closing pressure is able to be applied.

Furthermore, it is provided to realize the needle head so as to be rotatable in relation to a needle shank of the needle. As a result of such decoupling of needle shank and needle head, rotatability of the needle can be waived from a design of the trigger mechanism and conventional trigger mechanisms are also able to be used with a configuration of a paint spraying unit according to the present invention.

A multi-part realization of the needle, where the needle head forms a first component of the needle and where a needle shank forms a second component of the needle, involves the advantage of the needle shank and the needle head being adapted optimally to the existing requirements independently of one another.

A multi-part realization of the needle, where the needle head forms a first component of the needle and where a needle shank forms a second component of the needle and where the needle head is connected and, in particular, latched to the needle shank so as to be separable in a damage-free manner, involves the advantage of the needle head and the needle shaft being able to be exchanged independently of one another. As a result, it is also possible, in particular, to convert the paint spraying unit in a cost-efficient manner to a paint nozzle with a different needle as only the needle head of the needle has to be replaced.

Furthermore, it is provided to realize a nozzle body, which forms the paint nozzle, softer than the needle and, in particular, softer than the needle head. As a result, the advantages of the present invention are maintained even when the paint spraying unit is fitted inadvertently with a needle that does not match the nozzle body optimally.

With reference to a hardness which the needle head and/or the entire needle comprises, Rockwell hardness values of between 65 and 95 and, in particular, of approximately 80 are provided. As a result, the sealability and the wear-resistance are kept at an optimum ratio.

With reference to a hardness which the needle shank comprises, Rockwell hardness values of between 100 and 130 and, in particular, of approximately 115 are provided. With such values, optimum interaction between needle shank and needle head is ensured.

With reference to a hardness which the nozzle body comprises, Rockwell hardness values are greater than 100 and, in particular, greater than 115. With such values, the sealability and the wear-resistance are kept at an optimum ratio.

Furthermore, it is provided to realize the needle as a two-component plastics material injection molded part, wherein the needle head is formed by the first component and wherein a needle shank is formed by the second component. This makes it possible for the needle to be provided as an integral component in spite of the heterogenous properties of the needle head and the needle shank such that both needle replacement and spare part management are simplified.

Finally, it is provided to produce the needle shank from a plastics material with a melting point of greater than 200° C. and preferably greater than 215° C. and less than 240° C., wherein a polybutylene is used, in particular, as a first component, and to produce the needle head from a plastics material with a melting point of less than 200° C. and preferably greater than 170° C., wherein a polyamide is used, in particular, as a second component. As a result, the needle is producible in high quantities as a two-component injection molded part. Furthermore, sticking or interlinking of the needle shank and needle head can be avoided as a result during production such that the needle head is freely rotatable about the longitudinal axis of the needle in relation to the needle shank and, as a result, unwanted torsion of the needle cannot occur in operation.

BRIEF DESCRIPTION OF THE DRAWINGS

Further details of the present invention are described in the drawing by way of schematically shown exemplary embodiments, in which.

DETAILED DESCRIPTION OF THE INVENTION

Figure 1:
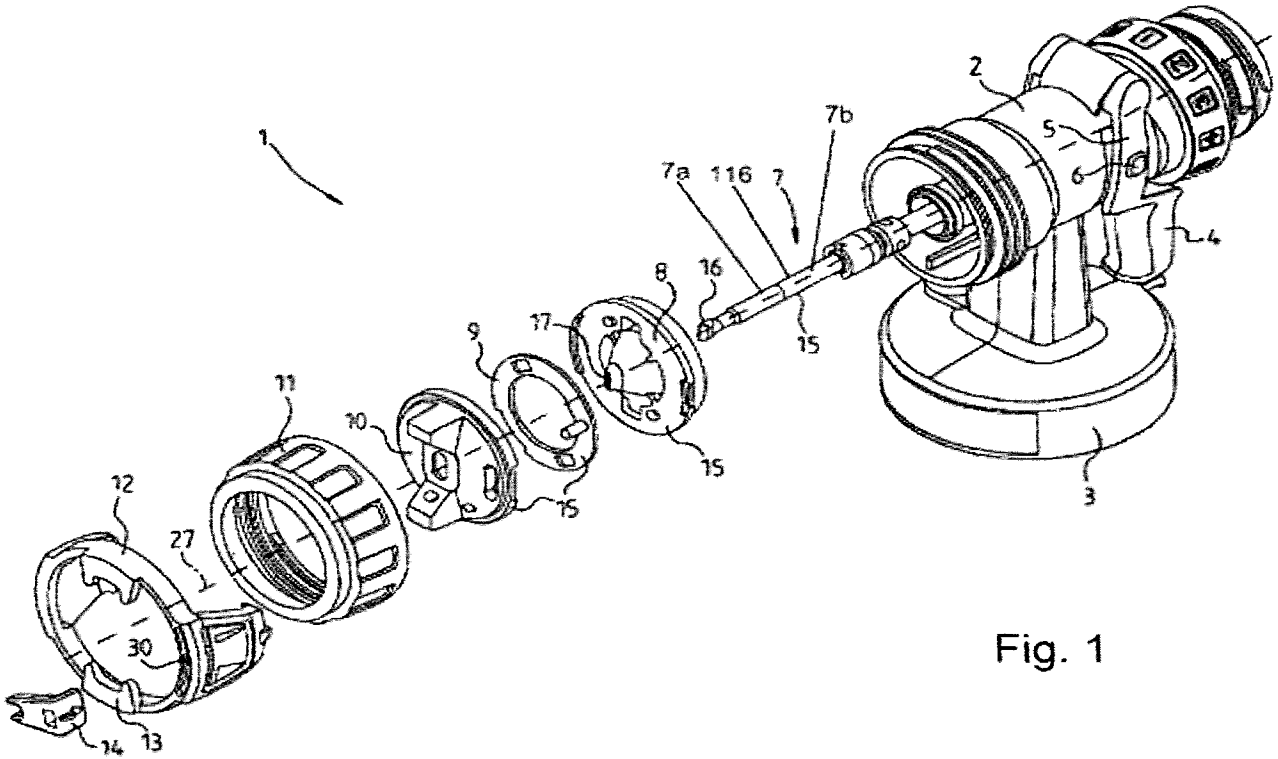
FIG. 1 shows a first exploded representation of a paint spraying unit according to the present invention.

FIG. 1 specifically shows an exploded representation of a paint spraying unit 1. The paint spraying unit 1 is formed basically by a body 2, at the bottom end of which a receiving means 3 for a paint container is provided. An alternative embodiment which is not shown is conceivable by the receiving means 3 for the paint container being omitted and a paint supply line supplying the body 2 with paint from a remote receptacle. This is described, for example, in German patent application DE 10 2009 048 022 of the applicant.

The body 2 has a trigger 4 which is freely suspended on a top side of the body 2 and entrains a coupling pin (shown in FIG. 4) via a blind hole, which is arranged at the side of the trigger lever 5, or a bore (hidden here by a cover cap 6). The coupling pin serves, as disclosed generally in the prior art, for pulling a needle 7 back against a spring ballast or the like in order to operate a needle valve 101 (see FIG. 2) for controlling a paint discharge.

The paint spraying unit 1 according to the present invention includes, along with the body 2 and the needle 7, an air link 8, a control disk 9, an air cap 10, a union nut 11 and a rotary actuator 12 with an entrainment means 13 arranged thereon and, where applicable, a further entrainment means 14 arranged thereon. The arrangement of the designated components in the direction of the air flow, proceeding from the body 2, is shown in the realization shown in FIG. 1. The needle 7 is realized in two parts and includes a needle head 16 as the first component 7*a* and a needle shank 116 as the second component 7*b*.

The air cap 10, the control disk 9, the air link 8 and the needle 7 form, in this case, a structural unit 15 which provides the technical prerequisites for the paint atomization process. In this case, the needle 7 engages with its needle head 16 in a paint outlet opening 17 which is arranged centrally in the air link 8. The needle head 16, in its wedge form, is adapted, in this case, to the form of the paint outlet opening 17 in such a manner that it closes the paint outlet opening in a paint-tight manner as a result of engagement in the completely pushed-in position. The technical principles of a needle valve, which, as a result of pulling back the needle, provides an opening gap in a paint outlet opening 17, through which paint can then emerge in a metered manner, are disclosed many times in the prior art for rotationally symmetrical needles and paint outlet openings.

Figure 2:
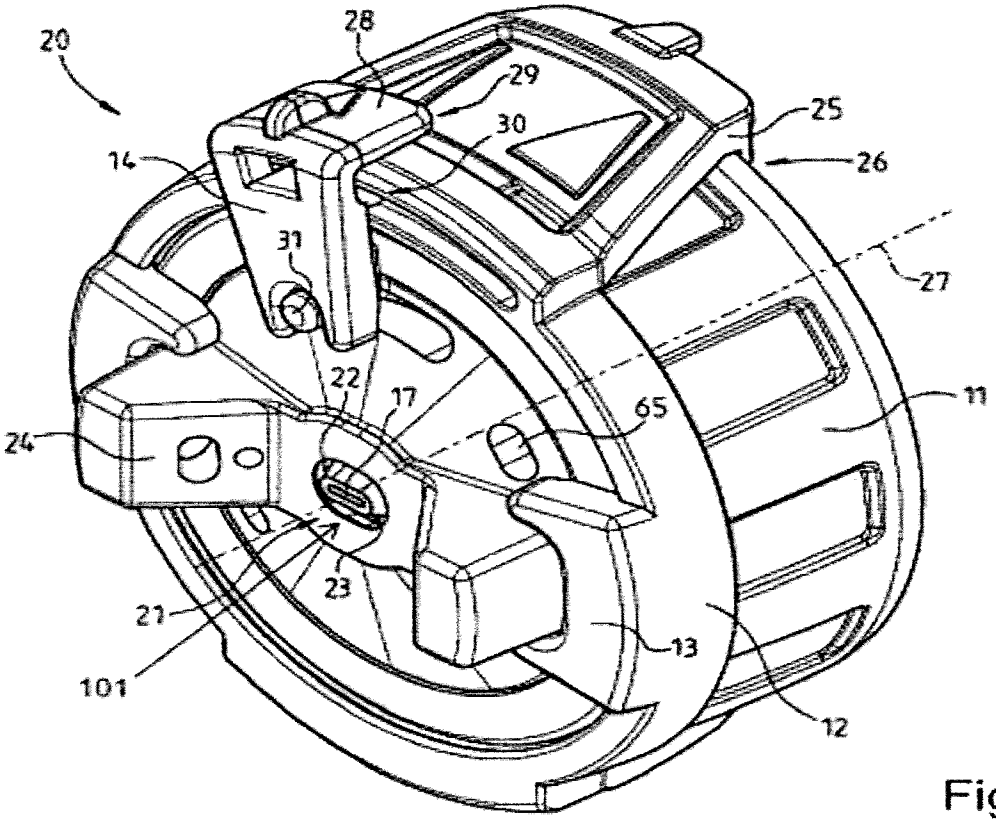
FIG. 2 shows an assembled paint spray head.

FIG. 2 shows an assembled realization of a spray head 20 of a paint spraying unit according to the present invention. The spray head 20, in this case, is formed by the air link 8, the control disk 9 arranged thereon, the air cap 10 covering the control disk 9, the union nut 11 arranged thereon as well as the rotary actuator 12 clamped thereon and the further entrainment means 14. The needle 7, proceeding from the side of the body 2, is not shown in the present case.

Figure 6:
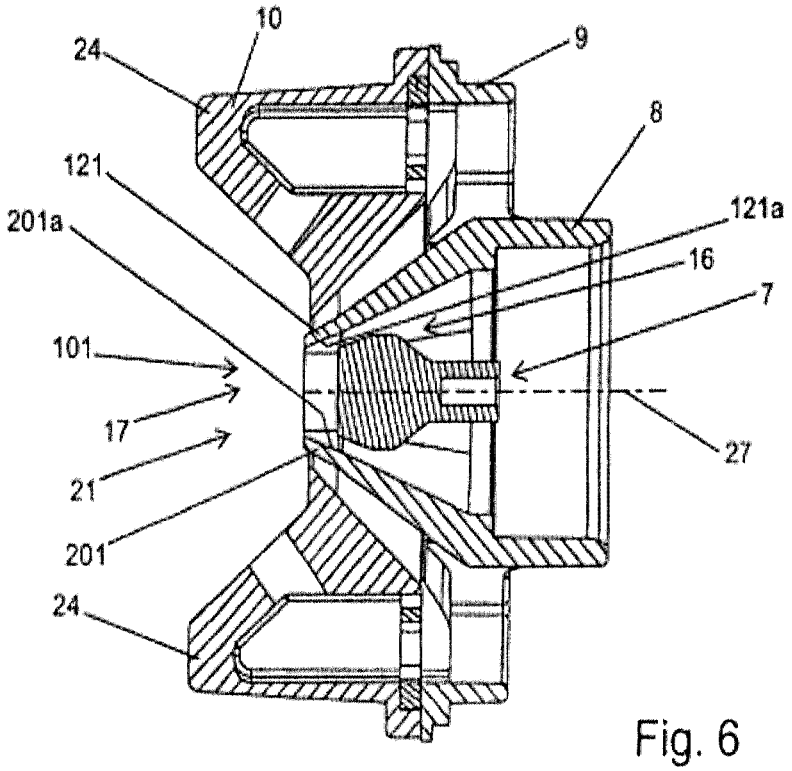
FIG. 6 shows a sectional representation of the air link, control disk and air cap.

A paint nozzle 21 is formed on the paint outlet side of the spray head 20 by a nozzle body 121 (see FIG. 6) with the paint outlet opening 17 and by the needle 7 (see, for example, FIG. 6). The paint nozzle 21, at the same time, forms the needle valve 101 which is closed or open in dependence on a position of the needle 7. The paint nozzle 21, which is slot-shaped in the present case, is arranged in the interior of an atomizer air opening 22 in the air cap 10. The edge of the atomizer air opening 22 and the edge of the paint outlet opening 17 define the ring gap 23 (see FIG. 2) which surrounds the paint nozzle 21 and through which the atomizer air flows for atomizing the paint emerging out of the paint outlet opening 17. A paint mist is generated in this way according to known atomization principles.

Air horns 24 are arranged in the continuation of a longitudinal axis 27 of the slot-shaped paint outlet opening 17 in such a manner that they direct a directed shaped air jet onto the paint mist, which emerges from the paint outlet opening 17 and the ring gap 23, and consequently further reinforces the realization of a flat jet. This principle is also disclosed in the prior art of the applicant which is named in the introduction.

The rotary actuator 12 is clamped on the union nut 11 via lateral clamping wings 25 (see FIG. 2), which rotary actuator is arranged so as to be rotatable about the longitudinal axis 27 by means of the positive closure 26 of the clamping wings 25 engaging behind the union nut 11 in this way. The rotary actuator 12 comprises entrainment means 13 which are arranged in each case corresponding to the air horns 24 and, as a result of the positive locking surrounding hold, ensure the air horns 24 are entrained when the rotary actuator 12 is rotated. In addition, the rotary actuator 12 comprises a caliper guide 30 in which the further entrainment means 14 is guided, the further entrainment means 14 once again being fastened on the rotary actuator 12 by means of a clamping wing 28 and a positive locking undercut 29 behind the rotary actuator 12 in such a manner that it is displaceable about the longitudinal axis 27 along a circular path along the caliper guide 27. The further entrainment means 14, in this case, controls a pin 31 which is arranged on the control disk 9. In this way, the control disk 9, located behind the air cap 10, is able to be rotated by the further entrainment means 14.

Figure 3:
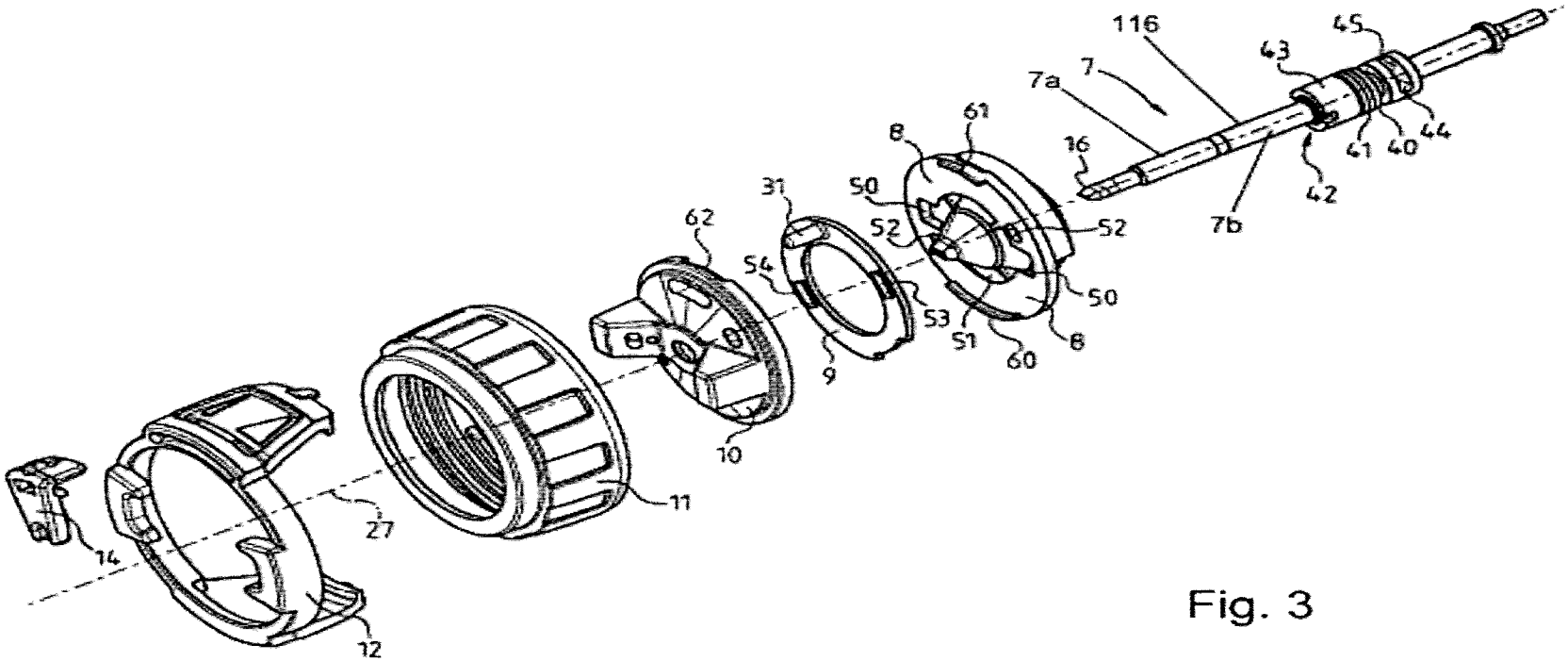
FIG. 3 shows a second exploded representation of a paint spray head with a needle.

FIG. 3 shows the exploded representation which is shown corresponding to FIG. 1, the pistol body 2 not being shown and the arrangement of the individual components having been rotated by 90° clockwise when viewed in the direction of the air flow.

The needle 7 comprises a sealing arrangement on its side remote from the needle head 16. The sealing arrangement includes a pressing surface 40, in front of which at least one seal 41 is arranged (two seals are provided in the present case). The seal or the seals 41 is or are held as a result of a thread 42, which is arranged on the needle 7, by means of a clamping nut 43 screwed thereon and the sealing action thereof can be adjusted as a result of prestressing the clamping nut 43 in a corresponding manner.

The passage 44 (see FIG. 3) for the coupling pin (shown in FIG. 4), which includes the pressure surfaces 45 for the transmission of energy for pulling back the needle 7, then follows the sealing arrangement in the rear direction of the needle 7.

The passage 44 is realized as a substantially quadrant-shaped passage 44, the passage 44 also being provided symmetrically to the longitudinal axis 27 on the other side of the needle (not shown here). As a result of the substantially quadrant-shaped realization of the passage 44, it is possible for the needle to be rotatable about an angle of approximately 90° corresponding to the passage opening 44 without torsional stresses acting through the coupling pin, which passes through the needle, onto the needle 7.

Figure 5:
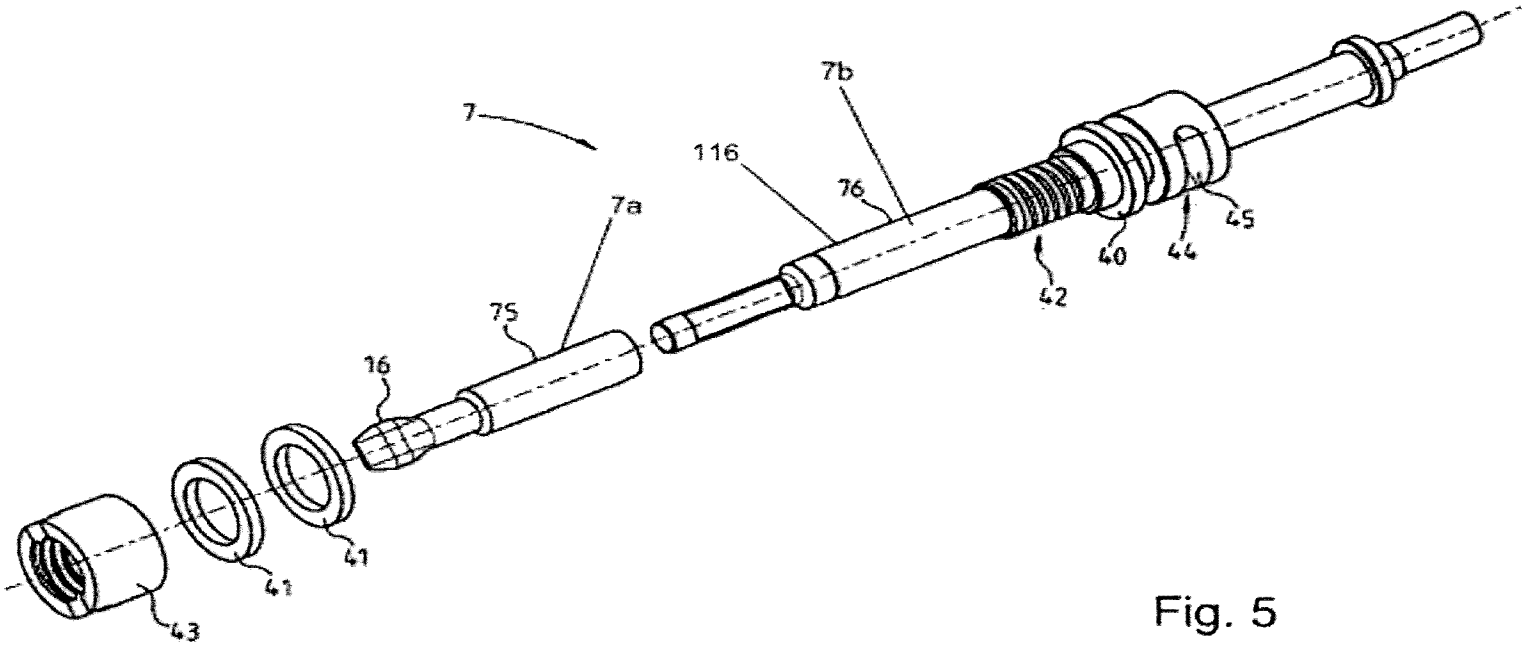
FIG. 5 shows a needle according to the invention for the paint spraying unit.

Along with the arrangement of the pressure surface 45 and of the seal, which will be described in more detail in subsequent FIG. 5, FIG. 3 shows the arrangement of the passage openings for the individual air guides. Along with the passage opening for the atomizer air 51, which subsequently passes through the ring gap 23 which is described in FIG. 2, the air link 8 includes passage openings for the horn air 50 and passage openings for the compensation air 52. The control disk 9 includes two control openings 53 and 54 which, when the control disk 9 is rotated about the longitudinal axis 27, can be made to coincide either with the passage openings for the horn air 50 or the passage openings for the compensation air 52. Corresponding air channels for the horn air and the compensation air are also present in the air cap 10.

The diameter of the control disk 9 is realized slightly smaller than the diameter of the air link 8. On its surface facing the control disk 9, the air link 8 comprises springs 60 and 61, between which the control disk 9 is inserted and guided when rotating about the longitudinal axis 27. At least one of the springs 60, 61, in this case, projects beyond the control disk 9 in the mounted state such that it engages in a groove 62, which is arranged in the air cap 10 on the contact side to the air link 8 and control disk 9, for the defined arrangement and fixing of the rotational position of the air cap 10.

The technical function of the described reversible air paths between an air passage through the horns 24 and an air passage through the compensation bores 65 is the avoidance of an increase in the inside air pressure inside the paint spraying unit. As fans are used for providing the working air in the majority of cases in the units and they utilize a certain volume flow for their own cooling purposes, it is disadvantageous to reduce the volume flow which can pass through a spray head. Consequently, as soon as the air horns 24, which form the spray jet, are switched off by means of the pin 31 as a result of the movement of the control disk 9 to influence the spray jet output, a reduced overall air volume flow would be provided without the compensation bores 65. This would have to be tolerated by the fan. Insofar as the fan relies on the volume flow for cooling purposes, the corresponding volume must be blown through the compensation bores in order to avoid increased backlog and to continue to cool the fan adequately. This technique is described in prior art EP 0 596 939 B1 for another genus of spray guns.

Figure 4:
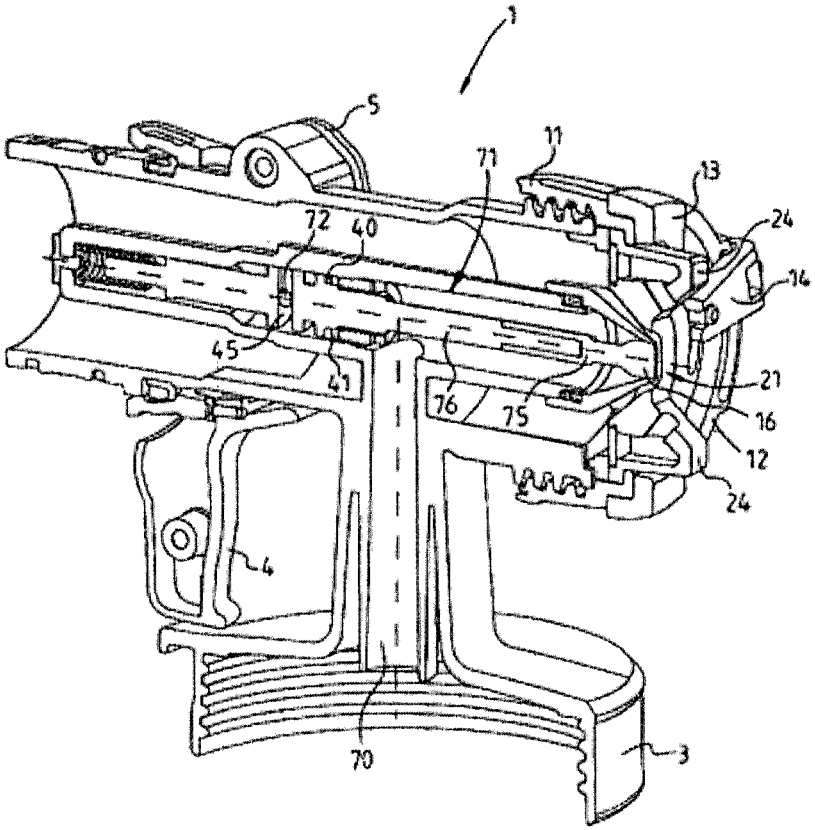
FIG. 4 shows a cross section through an assembled paint spraying unit.

FIG. 4 shows a cross section through a paint spraying unit 1 according to the present invention. The individual component parts are characterized corresponding to the above-described reference symbols.

Proceeding from a paint conveying tube (not shown) in a paint container, which is screwed to the receiving means 3, paint is transported through a rising tube 70 via the paint chamber 71 to the paint nozzle 21. The paint chamber 71, in this case, is realized substantially as a sleeve which receives the needle 7 completely and has a passage opening for the coupling pin 72 and the access of the rising tube 70. In operation, only the front part of the paint chamber 71 is filled with paint.

In the interior of the paint chamber, the needle 7 is arranged so as to be displaceable along the longitudinal axis 27 for opening the paint outlet opening 17. The needle can be provided as a two-part realization when, for example, a front portion 75 is to be produced with the needle head 16 from a different material to a rear portion 76. This is to be provided, for example, for the realization of the needle head as a wear part which is to be replaced more frequently compared to the rest of the arrangement. In principle, it would also be possible to realize a simple rotary joint by means of the parts of the front and rear portion 75, 76, which are pushed into one another, in order to mount the needle head 16 with the paint outlet opening 17 so as to be rotatable. In this case, the above-described semicircular passage could be omitted. A problem of the rather impaired embodiment could be the components sticking together as a result of the paint.

FIG. 5 shows a needle 7 according to the invention in detail. In contrast to the conventional implementations of the needle disclosed in the prior art where a sealing package is arranged fixedly in the housing, which is expensive and structurally elaborate, in the present case the sealing arrangement is fixed on the needle 7. Whether the needle is realized, in this case, as a two-part realization, as shown in the present case, or is present as a one-part needle, is not important to the sealing arrangement nor to the functionality described below.

Especially in the professional tools sector, sealing packages where the tension is able to be adjusted are often of great advantage. The adjustment or readjustment of a sealing tension brings about access to the optimum trigger pressure point which is determined by the sliding friction of the needle 7 in the seal, or in the present case by that of the seal 41 in the paint chamber 71.

The adjustability is provided in the present case as a result of the tension which is exerted by way of the clamping nut 43 on the sealing package, consisting of the two sealing rings 41. The clamping nut 43 is screwed on the thread 42 for this purpose against the seals 41 and presses them onto the pressing surface 40. Depending on the pressing force, a sealing bead, which brings about the sealing action in relation to the wall of the paint chamber 71, is generated radially outward from the longitudinal axis 27.

As an alternative to this, it is also possible for a coupling means of the needle trigger 4, 5 to abut against a, with reference to the longitudinal axis 27, radial broadening or radial constriction of the needle 7 and to move this consequently in the manner of a disk entrainment means.

The present invention consequently also includes a paint spraying unit for generating a paint jet with a needle 7 which is received so as to be displaceable in a channel, a paint-conducting portion of the channel being sealed by a seal which encases the needle, and the seal being fixed in the axial direction to the needle.

The seal, in this case, is fixed between a first stop and a second stop, at least one stop preferably being adjustable in the axial direction along the needle.

For improved guiding of the seal, the seal is fixed to the needle in the circumferential direction, for example, by a positive locking tongue-groove rotary fixing or a rough structure on the pressing surface 40, e.g. a lock washer structure.

Insofar as the needle 7 is provided in two parts or multiple parts, the front needle portion 75 and the rear needle portion 76 can be realized so as to be rotatable with respect to one another about a common longitudinal axis 27. It is advantageous, in this case, that the first material of the front portion 75 is a plastics material (for example, polyoxymethylene material) and that the second material of the rear portion 76 is a metal material (for example, cast zinc). During production, in this case, the front portion 75 can be connected to the rear portion 76 as a result of overmolding the rear portion.

It is furthermore advantageous for the paint outlet opening 17 to be realized from a third material which is harder than the material of the front needle portion 75 and for the third material to be, in particular, ceramic and, in particular, sintered ceramic.

FIG. 6 shows a sectional representation of the already disclosed components air link 8, control disk 9 and air cap 10, the needle head 16 also being shown. The paint outlet opening 17, which is realized in the air link 8, together with the needle head 16 forms the paint nozzle 21. In this connection, the needle head 16 is in a retracted position such that the paint nozzle 21 is open. In this connection, a nozzle body 121, which forms the paint outlet opening 17, is formed from an elastic material 201 in a circular shape with respect to its inside 121*a* around the paint nozzle 21 such that, with the needle valve 101 in the closed position, the needle head 16 abuts against a surface region 201*a* of the elastic material 201 and in so doing deforms the surface region elastically.

Figure 7:
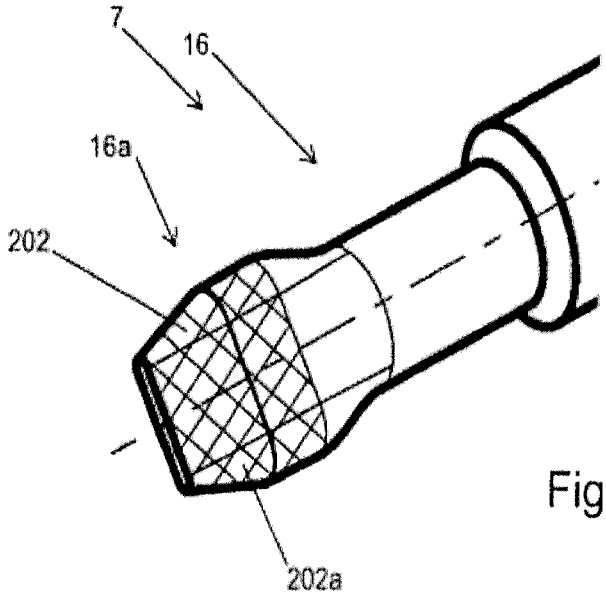
FIG. 7 shows a representation of a detail of the two-part needle shown in the previous figures.

FIG. 7 shows the needle 7 disclosed in the preceding figures in a view of a detail of its needle head 16. A tip 16*a* of the needle head 16 is formed from an elastic material 202 such that the needle head 16, with the needle valve in the closed position, abuts with a surface region 202*a*, which is formed by the elastic material 202, against the nozzle body in the region of the paint outlet opening thereof, in so doing the needle head 16 or the tip 16*a* of the needle head 16 being elastically deformed. The elastic material 202 is symbolized in FIG. 7 by cross hatching.

According to a realization variant that is not shown, it is also provided to realize either only the nozzle body or only the needle head with an elastic surface region such that, with the needle valve in the closed position, in each case only the nozzle body or the needle head is elastically deformed. The respectively other surface region in these cases is then realized from a less elastic or non-elastic material such as, for example, a hard plastics material or a metal.

Figure 8:
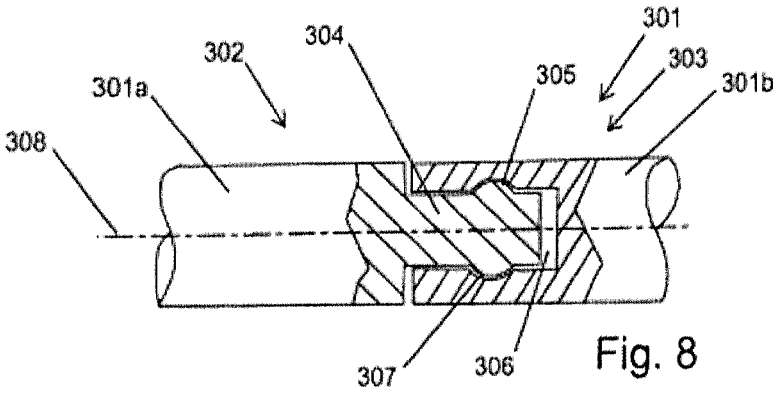
FIG. 8 shows a schematic representation of a second realization variant of a two-part needle.

FIG. 8 shows a schematic representation of a partially sectioned view of a detail of a second realization variant of a needle 301. The needle 301 is realized in two parts and includes a needle head 302 and a needle shank 303, the needle head 302 forming a first component 301*a* of the needle 301 and a needle shank 303 forming a second component 301*b* of the needle 301. The needle head 302 is received by a rotationally symmetrical lug 304 with a bead 305 in a bore 306 of the needle shank 303. In this connection, the bore 306 includes a recess 307 which is adapted to the bead 305 in such a manner that the bead, with the needle head 302 and the needle shank 303 plugged together, is held in such a manner in the bore 306 that tensile and compressive forces are able to be transmitted largely without play in the direction of the longitudinal axis 308 of the needle 301 and that the needle head 302 is infinitely rotatable about the longitudinal axis 308 in relation to the needle shank 303. As a result of a correspondingly elastic realization of the bead 305 and/or of the needle shank 303, the needle head 302 and the needle shank 303 are separable and connectable in a damage-free manner. As a result, it is also possible to replace the needle head 302 or the needle shank 303.

Figure 9:
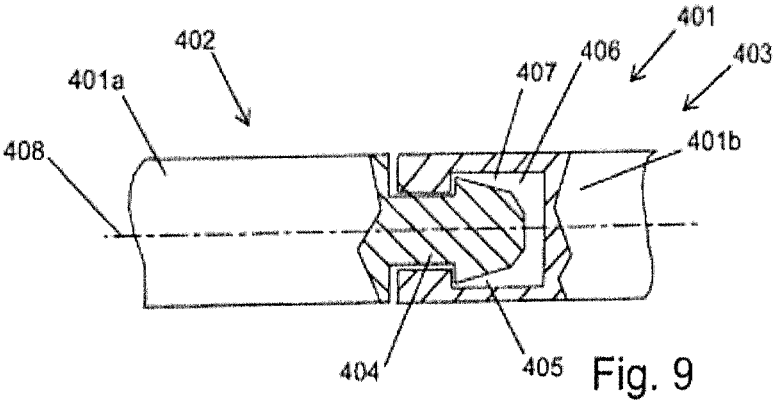
FIG. 9 shows a schematic representation of a third realization variant of a two-part needle and FIG. 10 shows a schematic representation of a fourth realization variant of a two-part needle.

FIG. 9 shows a schematic representation of a partially sectioned view of a detail of a third realization variant of a needle 401. The needle 401 is realized in two parts and includes a needle head 402 and a needle shank 403, the needle head 402 forming a first component 401*a* of the needle 401 and a needle shank 403 forming a second component 401*b* of the needle 401. The needle head 402 is received by a rotationally symmetrical lug 404 with a journal 405 in a bore 406 of the needle shank 403. In this connection, the bore 406 includes a recess 407 which is adapted to the journal 405 in such a manner that the journal, with the needle head 402 and the needle shank 403 plugged together, is held in such manner in the bore 406 that tensile and compressive forces are able to be transmitted largely without play in the direction of a longitudinal axis 408 of the needle 401 and that the needle head 402 is infinitely rotatable about the longitudinal axis 408 in relation to the needle shank 403. As a result of orienting the contact surfaces of the journal 405 and the recess 407 transversely to the longitudinal axis 408, the needle 401, once the needle head 402 and the needle shank 403 have been plugged together, is no longer separable without destruction. The advantage here is that the needle is able to receive high tensile forces and consequently even a needle 401 which is stuck fast in the gap of the paint nozzle is able to be released again without there being any risk of separating the needle shank 403 from the needle head 402.

Figure 10:
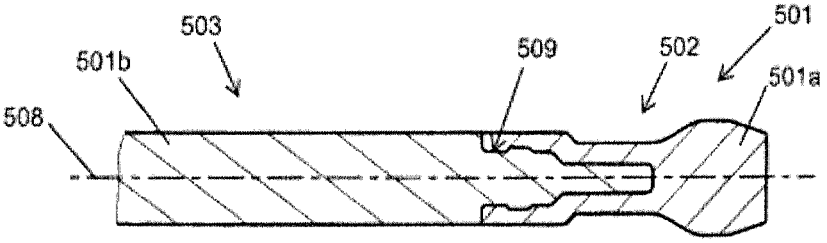

FIG. 10 shows a schematic representation of a sectioned view of a detail of a fourth realization variant of a needle 501. The needle 501 is realized in two parts and includes a needle tip, which is designated as the needle head 502, and a needle shank 503, the needle head 502 forming a first component 501*a* of the needle 501 and a needle shank 503 forming a second component 501*b* of the needle 501. The needle 501 is realized as a two-component injection molded part. In this connection, the needle shank 503 is produced from a plastics material with a melting point which is greater than a melting point of a plastics material from which the needle head 502 is produced. The needle shank 503 is produced from a plastics material with a melting point of greater than 200° C. and preferably greater than 215° C. and less than 240° C., a polybutylene being used, in particular, as the material or first component. The needle head 502 is produced, in particular, from a plastics material with a melting point of less than 200° C. and preferably greater than 170° C., a polyamide being used, in particular, as the material or second component. According to a realization variant, it is also provided to configure the two-component injection molding process in such a manner that first of all a needle shank is produced and then the needle shank is placed in an injection mold as an insert part and there is injected around with a needle head. In this connection, the materials are selected such that the needle head does not melt or interlink with the needle shank. In principle, once the needle 501 has been produced, the needle head 502 is rotatable in relation to the needle shank 503 about a longitudinal axis 508 of the needle 501. However, the needle shank 503 comprises an undercut 509 which the needle head 502 engages over and by means of which the needle head is held on the needle shank 503 in the direction of the longitudinal axis 508.

LIST OF REFERENCES

1 Paint spraying device
2 Body
3 Receiving means
4 Trigger
5 Trigger lever
6 Cover cap
7 Needle
**7*a*** First component
**7*b*** Second component
8 Air link
9 Control disk
10 Air cap
11 Union nut
12 Rotary actuator
13 Entrainment means
14 Further entrainment means
15 Structural unit
16 Needle head
**16*a* Tip of 16**
17 Paint outlet opening
20 Spray head
21 Paint nozzle
22 Atomizer air opening
23 Ring gap
24 Air horn
25 Clamping wing
26 Positive locking closure
27 Longitudinal axis
28 Clamping wing
29 Positive locking undercut
30 Caliper guide
40 Pressing surface
41 Seal
42 Thread
43 Clamping nut
44 Passage
45 Pressure surface
50 Passage opening for the horn air
51 Passage opening for the atomizer air
52 Passage opening for the compensation air
53 Control opening
54 Control opening
60 Spring
61 Spring
62 Groove
65 Compensation bore
70 Rising tube
71 Paint chamber
72 Coupling pin
75 Front portion
76 Rear portion
101 Needle valve
116 Needle shank
121 Nozzle body
**121*a*** Inside
201 Elastic material

201*a* Surface region of 201
202 Elastic material
202*a* Surface region of 202
301 Needle
301*a* First component
301*b* Second component
302 Needle head
303 Needle shank
304 Rotationally symmetrical lug
305 Bead
306 Bore
307 Recess
308 Longitudinal axis
401 Needle
401*a* First component
401*b* Second component
402 Needle head
403 Needle shank
404 Rotationally symmetrical lug
405 Journal
406 Bore
407 Recess
408 Longitudinal axis
501 Needle
501*a* First component
501*b* Second component
502 Needle body
503 Needle shank
508 Longitudinal axis
509 Undercut on 503

The invention claimed is:

1. A paint spraying unit for generating a shaped paint jet, comprising a paint nozzle that is positioned in a gap, wherein the paint nozzle includes a needle with a needle head that deviates from a rotationally symmetrical cross section thereof and a paint outlet opening that deviates from a rotationally symmetrical cross section thereof, wherein the needle head is displaceable in relation to the paint outlet opening along a longitudinal axis of the needle for controlling a needle valve formed by the paint outlet opening and the needle head, wherein the needle head, which has an abutting end surface, with the paint nozzle in a closed position with reference to the longitudinal axis, closes the paint outlet opening in a positive locking manner, and wherein the needle head and the paint outlet opening are formed by a material with elastic properties at least in a surface region with which two components come into contact;

wherein the needle is a plastic material part comprising a first component of the two components and a second component of the two components, wherein the needle head comprises the first component and wherein a needle shank comprises the second component, with the needle shank, which extends in the longitudinal axis toward the needle head, comprising a shank outer surface that has an undercut formed in the shank outer surface at a spaced distance from an outermost end of the needle shank along the longitudinal axis, and an end portion of the needle head, which is opposite to the abutting end surface of the needle head, has an inner shape corresponding to the undercut on the needle shank that is engaged and held in the undercut on the needle shank along the longitudinal axis, such that an interlocked connection, which is configured to transmit tensile and compressive forces between the needle head and the needle shank, is formed between the end portion of the needle head and the undercut on the needle shank, and the needle head is fully rotatable about the longitudinal axis in relation to the needle shank;

wherein the needle shank comprises a plastics material having a melting point of greater than 200 degrees C., and less than 240 degrees C., wherein the material forming the needle head is a plastic having a melting point of less than 200 degrees C., wherein the needle head is softer than a nozzle body that forms the paint outlet opening, and wherein the needle head is softer than the needle shank.

2. The paint spraying unit as claimed in claim 1, wherein the paint outlet opening is rotatable about the longitudinal axis together with the needle head in order to rotate the shaped paint jet in its orientation with reference to the longitudinal axis.

3. The paint spraying unit as claimed in claim 1, wherein the needle head is connected to the needle shank so as to be separable in a damage-free manner.

4. The paint spraying unit as claimed in claim 1, wherein one of the needle head or the entire needle has a Rockwell hardness of between 65 and 95.

5. The paint spraying unit as claimed in claim 1, wherein the needle shank has a Rockwell hardness of between 100 and 130.

6. The paint spraying unit as claimed in claim 1, wherein a nozzle body has a Rockwell hardness of more than 100.

7. The paint spraying unit as claimed in claim 1, wherein the needle head is also formed by the material with elastic properties in a core region which connects directly to its surface region.

8. The paint spraying unit as claimed in claim 1, wherein the entire needle is softer than the nozzle body that forms the paint outlet opening.

9. The paint spraying unit as claimed in claim 1, wherein the nozzle body is softer than the entire needle.

10. The paint spraying unit as claimed in claim 4, wherein the Rockwell hardness of the one of the needle head or the entire needle is 80.

11. The paint spraying unit as claimed in claim 5, wherein the Rockwell hardness of the needle shank is 115.

12. The paint spraying unit as claimed in claim 6, wherein the Rockwell hardness of the nozzle body is more than 115.

13. The paint spraying unit as claimed in claim 1, wherein the needle shank is produced from a plastics material having a melting point of greater than 215° C. and the needle head is produced from a plastics material having a melting point greater than 170° C.

14. The paint spraying unit as claimed in claim 13, wherein the needle shank is made from polybutylene and the needle head is made from polyamide.

* * * * *